US007265720B1

(12) United States Patent
Ponce De Leon et al.

(10) Patent No.: US 7,265,720 B1
(45) Date of Patent: Sep. 4, 2007

(54) PLANAR INVERTED-F ANTENNA WITH PARASITIC CONDUCTOR LOOP AND DEVICE USING SAME

(75) Inventors: Lorenzo A. Ponce De Leon, Lake Worth, FL (US); Jacob Marvin, Plantation, FL (US); Naveed Mirza, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/618,037

(22) Filed: Dec. 29, 2006

(51) Int. Cl.
*H01Q 1/24* (2006.01)
*H01Q 1/38* (2006.01)

(52) U.S. Cl. ..... 343/700 MS; 343/702; 343/834; 343/846

(58) Field of Classification Search ..... 343/700 MS, 343/702, 833, 834, 846, 848
See application file for complete search history.

(56) References Cited

U.S. PATENT DOCUMENTS

| | | | | |
|---|---|---|---|---|
| 6,476,767 | B2 * | 11/2002 | Aoyama et al. | 343/700 MS |
| 7,026,999 | B2 * | 4/2006 | Umehara et al. | 343/702 |
| 2005/0057401 | A1 * | 3/2005 | Yuanzhu | 343/700 MS |
| 2005/0168384 | A1 * | 8/2005 | Wang et al. | 343/700 MS |
| 2007/0057849 | A1 * | 3/2007 | Moon et al. | 343/700 MS |
| 2007/0139270 | A1 * | 6/2007 | Takei et al. | 343/700 MS |

* cited by examiner

*Primary Examiner*—Tan Ho
(74) *Attorney, Agent, or Firm*—Scott M. Garrett

(57) ABSTRACT

A planar inverted-F antenna structure (204) is parasitically coupled to a conductor loop (214) at an open end (208) of the main radiator of the inverted-F antenna. The conductor loop is grounded (216).

15 Claims, 3 Drawing Sheets

PLANAR INVERTED-F ANTENNA WITH PARASITIC CONDUCTOR LOOP AND DEVICE USING SAME

FIELD OF THE INVENTION

The invention relates generally to communication devices, and more particularly to compact antenna structures for use in multi-mode mobile communication devices.

BACKGROUND OF THE INVENTION

Mobile communication devices are in widespread use throughout the world, and especially in metropolitan regions of the world. These devices have evolved from simple devices that merely support wireless mobile telephony to multi-function, multi-mode devices that can communicate in a variety of frequency bands using a variety of air interface protocols, modulation schemes, and so on. Manufactures have worked to keep such device relatively inexpensive, as well as physically small with ever decreasing electrical power consumption rates.

The combination of making the device multi-modal and the desire to keep the device physically small has caused designers and manufactures to find ways of combining circuits and circuit elements such that they can be used for multiple modes, rather than having dedicated circuits and systems for each mode of communication. One of the components of mobile communication devices that occupy a substantial space is the antenna structure and supporting circuitry and mechanical features. Typical whip antennas do not perform well across multiple bands, and require a substantial amount of mechanical support. Using multiple antennas for different bands also increases the space occupied by antennas. Therefore there is a need for a compact, multi-band antenna structure that reduces the amount of space and mechanical features needed in the device.

SUMMARY OF THE INVENTION

The present invention discloses in one embodiment a planar inverted F antenna structure including a ground plane, a main radiator, and a parasitic conductor loop coupled to the main radiator. The main radiator includes a closed end section coupled to the ground plane from a central portion of the main radiator. The main portion extends to an open end. The main radiator also has a feed point located on the central portion between the closed end and the open end. The parasitic conductor loop is disposed in proximity to, and parasitically coupled with, the open end of the main radiator. The parasitic conductor loop is also grounded to the ground plane.

In another embodiment of the invention the inverted F antenna structure is incorporated into a mobile communication device.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1:
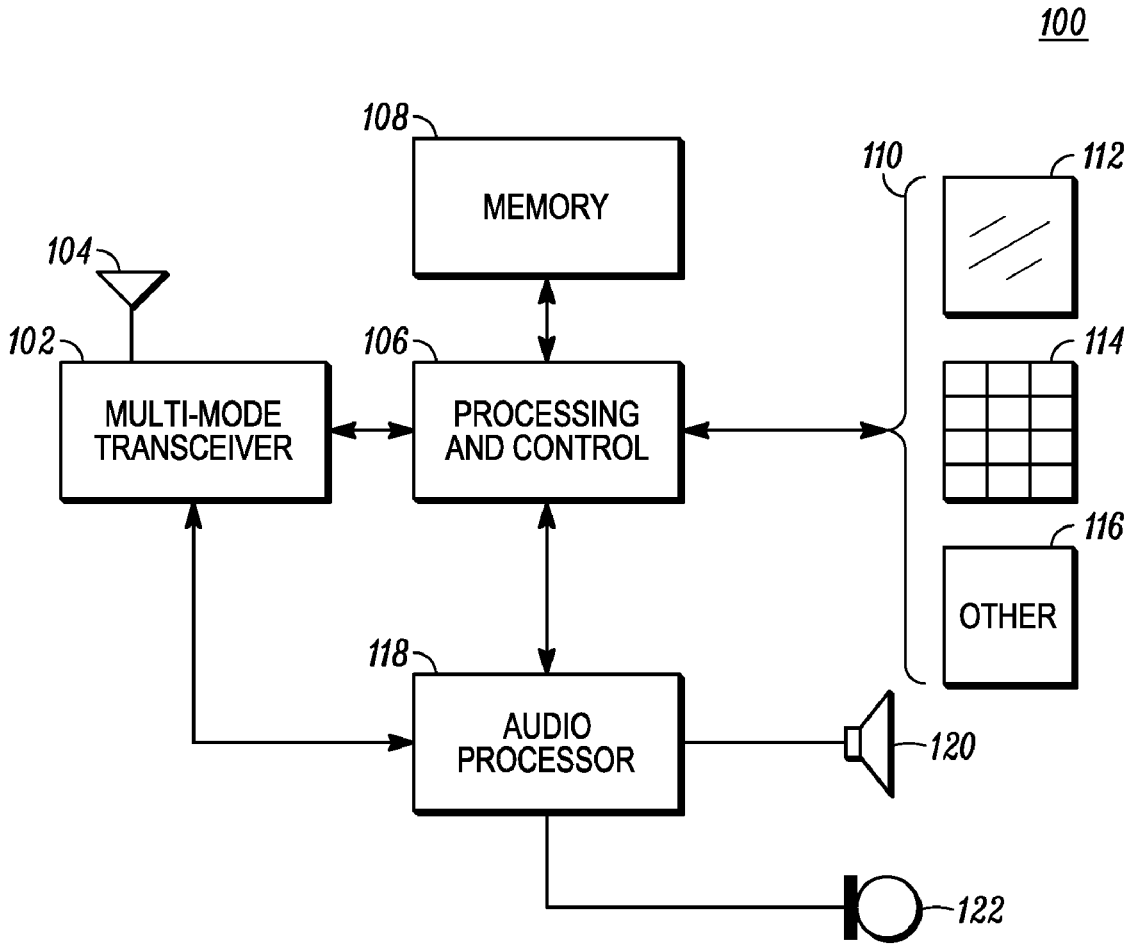
FIG. 1 shows a block schematic diagram of a multi-mode mobile communication device, in accordance with an embodiment of the invention.

Referring now to FIG. 1, there is shown a block schematic diagram of a multi-mode mobile communication device 100, in accordance with an embodiment of the invention. The device includes a multi-mode transceiver 102 which generates and receives radio frequency signals in accordance with various communication protocols and specifications. The transceiver is coupled to an antenna structure 104, which is an inverted F antenna having a parasitic loop, in accordance with the invention. The transceiver is further coupled to a processing and control block 106. The processing and control block includes processing elements such as microprocessors and digital signal processors, for example. These elements are used to execute instruction code which facilitates control and operation of the device. The processing elements may, for example, process voice and data so that it may be modulated for transmission, or receive demodulated data and process it to produce voice and data information. The processing block is coupled to a memory 108, which is abstracted here to represent a variety of memory elements that may be used for storage of instruction code, data, and other information, as well as memory for instantiating applications and instruction code for execution, and for storing temporary variables used when executing the instruction code. Thus, the memory may include read only memory, programmable memory, volatile and non-volatile memory, random access memory, and so on, as is well known. The processing block may also be used to control a user interface 110. The user interface includes hardware and software elements for interacting with a user to allow the user to operate and control the device, and well as receive information from and put information into the device. The device therefore may include a graphical display 112 or displaying visual information. The device may further include a keypad and other buttons 114 for entering information into the device. Other elements 116 may be used to provide information, such as, for example, a vibratory motor. To facilitate voice communication, and other audiorelated task, the device includes an audio processor 118. The audio processor is coupled to the transceiver and processing block, and processes audio signals received at the transceiver so that they may be played over a speaker 120 or other audio transducer. Typically the audio processor receives digital audio signals and coverts them to analog signals. Similarly, the audio processor receives analog audio signals via a microphone 122 and coverts the analog audio signals to digital audio signals, which may be processed and transmitted by the transceiver.

Figure 2:
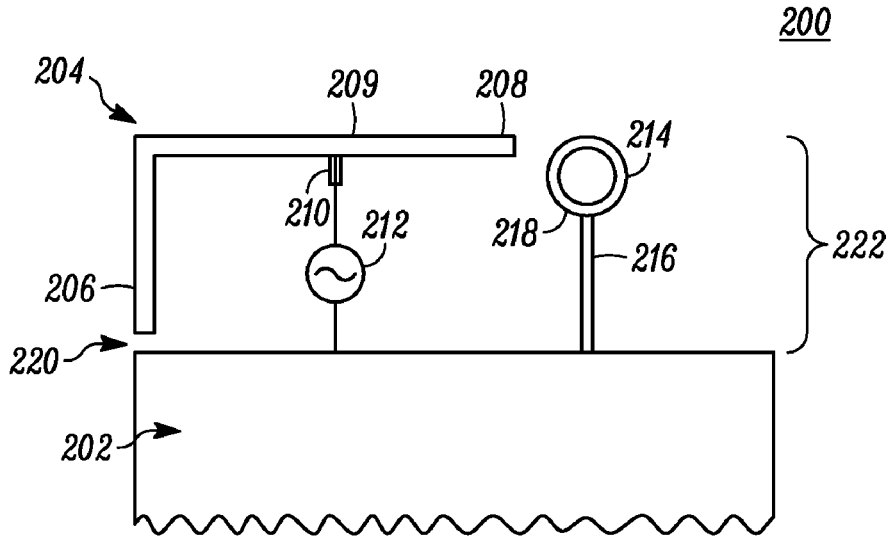
FIG. 2 shows an antenna structure diagram, in accordance with an embodiment of the invention.

Referring now to FIG. 2, there is shown therein an antenna structure diagram 200, in accordance with an embodiment of the invention. The antenna structure is an inverted F antenna structure with a coupled parasitic loop. The antenna structure is disposed in proximity to a ground plane 202 which provides a counterpoise to a main radiator 204. The main radiator 204 is a conductive member, and includes a closed end 206 which extends or runs away from the ground plane. The main radiator further includes an open end 208 which is oriented differently than the closed end, and is integrally connected to the closed end by a central portion 209. In the present embodiment, the closed end and open ends are oriented 90 degrees with respect to each other. The main radiator is fed at the central portion at a feed point 210 where the impedance is matched for the signal source 212, which is typically the output of a radio frequency power amplifier, or the input to a radio frequency receiver. The antenna structure further includes a parasitic conductor loop 214 that is coupled to the ground plane by a ground line 216. The parasitic conductive loop is disposed near or proximate to the open end 208 of the main radiator 204 so that there is coupling between the loop and main radiator. This point of the main radiator is a high E-field point. The loop size affects the bandwidth of the antenna structure. To further enhance the bandwidth of the antenna structure, the closed end 206 of the main radiator is capacitively coupled to the ground plane, such as by opening an aperture 220 between the closed end and the ground plane. By capacitively coupled it is meant that there is no direct current path between the ground plane and the closed end, and the two are coupled by capacitance. The capacitance may be the inherent capacitance of the structure, or a capacitor component may be used across the slot of aperture. When a capacitor component is used, a series inductance may be used with the capacitor component. In the present example, the main radiator and parasitic conductor loop structure both extend away from the ground plane by the same distance 222. The width of the conductor of the loop and the proximity of the loop to the closed end affect the bandwidth of the antenna. As the width of the conductor of the conductor loop is increased, the bandwidth generally increases.

Figure 3:
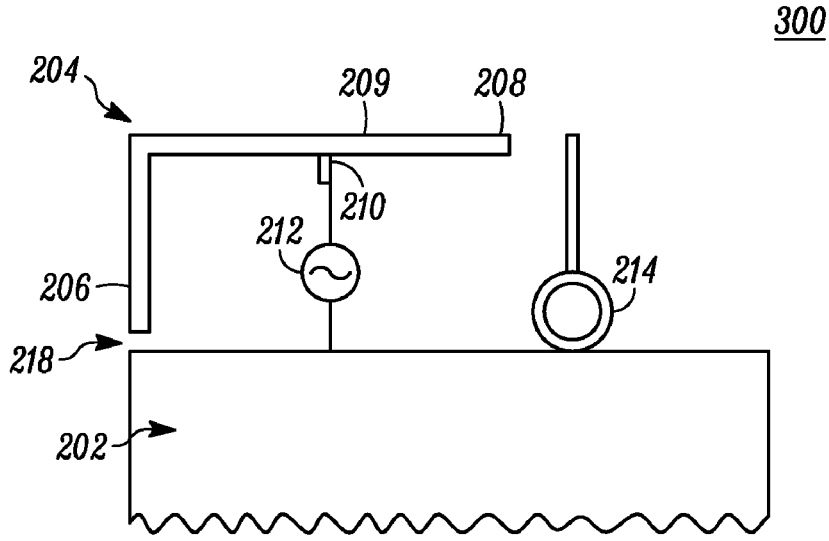
FIG. 3 shows an antenna structure diagram, in accordance with an embodiment of the invention.

The loop operates in two main modes, a common mode and a differential mode. In the common mode the ground line 216 and the loop 214 operate as a monopole radiating against the ground plane 202. In this mode the first resonance frequency occurs when the electrical sum of the lengths of half the loop 214 perimeter and the ground line 216 equals a quarter wavelength. In the differential mode the currents circulate around the perimeter of the loop 214 and the first resonance frequency occurs when the electrical length of the perimeter of the loop 214 equals a half-wavelength. Adjusting the perimeter of the loop 214 and the length of ground line 216 adjust the frequency of the response. Furthermore, the position of the loop and the ground line can be reversed as shown in FIG. 3. Both modes electromagnetically couple into the main antenna, extending the frequency response of main antenna so that it can be designed to cover additional bands.

The main radiator is a conventional inverted F antenna structure, disposed coplanar with the ground plane rather than over and normal to the ground plane. This arrangement is referred to a planar inverted-F antenna (PIFA). The addition of the grounded parasitic loop structure, however, substantially enhances the bandwidth of the structure. The loop may be grounded at the point 218 on the loop closest to the ground plane. FIG. 3 shows an alternative structure 300 where the loop and ground line are inverted such that the loop is directly coupled with the ground plane and a strip extends from the loop towards the open end of the main radiator.

Figure 4:
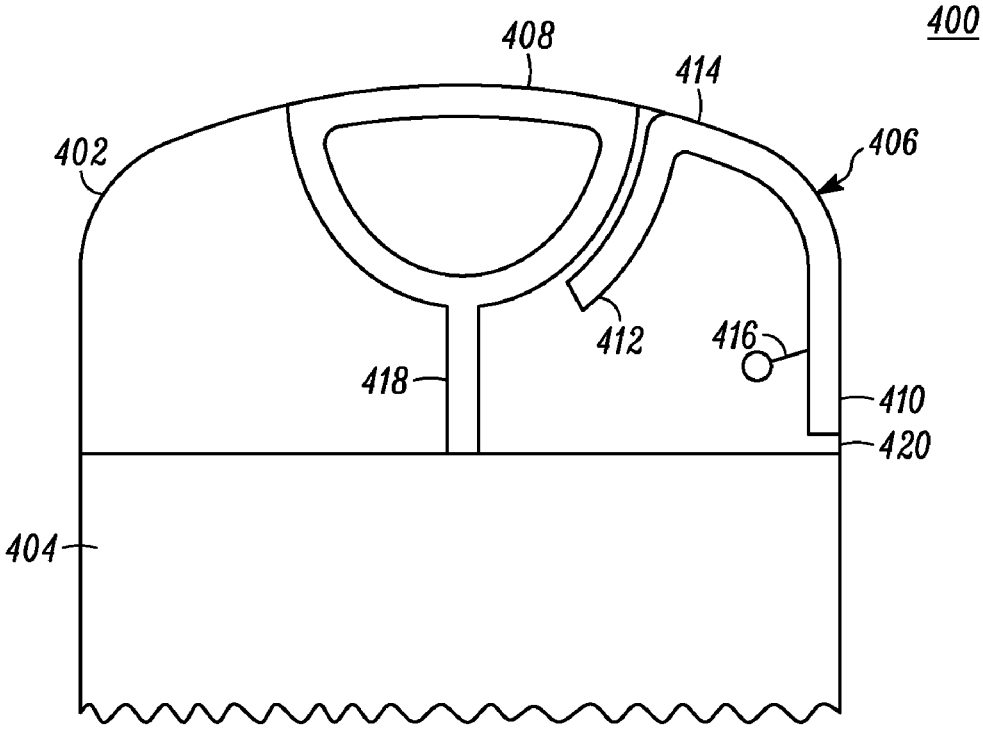
FIG. 4 shows a circuit board incorporating an antenna structure, in accordance with an embodiment of the invention.

Referring now to FIG. 4, there is shown therein a circuit board 400 incorporating an antenna structure, in accordance with an embodiment of the invention. The circuit board includes a substrate 402 on which there is disposed a ground plane 404. The ground plane is simply a region of conductor which operates as the reference potential and counterpoise for the antenna structure. The antenna structure includes a main radiator 406 and a parasitic conductor loop 408. The main radiator has a closed end 410 and an open end 412 with a central portion 414 disposed between the closed and open ends. A feed point 416 is located on the central portion at an impedance matching point. In the present embodiment, the main radiator extends from the closed end along an edge of the circuit board. The open end extends away from the edge, towards an interior region of the circuit board. The open end in the present embodiment also curves around the loop 408 to increase coupling between the main radiator and the parasitic loop structure. The loop structure is grounded via a ground strip 418. The loop may also conform partially to the shape of the edge of the circuit board. The center of the loop may be an opening through the circuit board to allow some portion of the device, such as a fastener, pass through the circuit board. Furthermore, the main radiator structure may be coupled to the ground plane via a capacitive coupling means, such as a slot 420 between the ground plane and the closed end of the main radiator. It is further contemplated that the capacitive coupling my use a capacitor component mounted across the slot or gap 420. It is still further contemplated that the capacitor component may be a varactor so as to allow some tuning of the antenna structure by varying the capacitive coupling.

Figure 5:
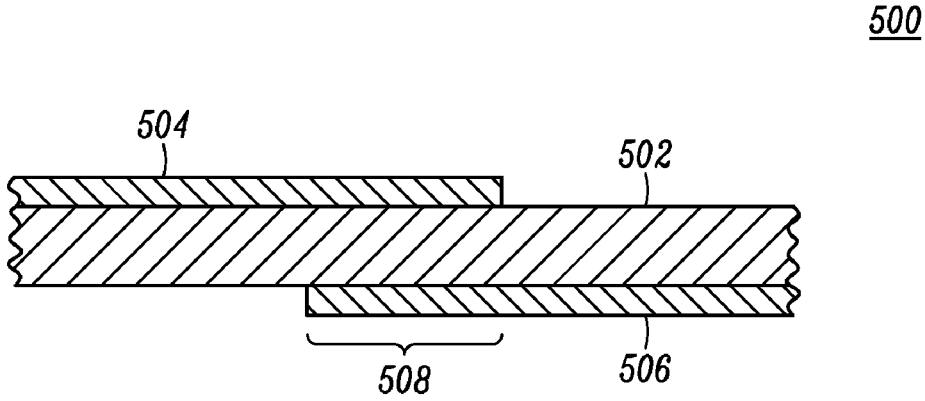
FIG. 5 shows a side cut-away view of a circuit board and antenna structure, in accordance with an embodiment of the invention.

The antenna structure as shown herein is relatively simple to implement as it may be formed by use of conventional circuit board design techniques. The antenna structure and ground plane may be formed on the same layer of the circuit board, or as shown in FIG. 5, they may be on different layers of the circuit board. FIG. 5 shows a side cut-away view of a circuit board 500 in accordance with an embodiment of the invention. The circuit board includes a substrate 502 that is non-conductive. In a typical circuit board for a mobile communication device, the circuit board will have a plurality of conductor layers and substrate layers alternating, as is well known. In the present example, the closed end 504 of the main radiator of an inverted F antenna structure is disposed on one conductor layer, and the ground plane 506 is disposed on an adjacent conductor layer. To increase the capacitive coupling between the closed end and the ground plane overlap 508 in an overlap region.

Thus, the invention provides a planar inverted F antenna coupled to a parasitic conductor loop. The inverted F antenna has a closed end coupled to a ground plane, and an open end parasitically or non-conductively coupled to the parasitic conductor loop. The parasitic conductor loop structure is grounded to the ground plane. This invention can be embodied in other forms without departing from the spirit or essential attributes thereof. Accordingly, reference should be made to the following claims, rather than to the foregoing specification, as indicating the scope of the invention.

What is claimed is:

1. An antenna structure, comprising:

a ground plane;

a main radiator including a closed end section coupled to the ground plane from a central portion of the main radiator, the main portion extending to an open end, the main radiator further having a feed point located on the central portion between the closed end and the open end, the closed end being capacitively coupled to the ground plane; and a parasitic conductor ring disposed in proximity to and parasitically coupled with the open end, and grounded to the ground plane.

2. An antenna structure as defined in claim 1, wherein the open end extends from the main body section along a portion of the parasitic conductor ring.

3. An antenna structure as defined in claim 1, wherein the closed end is capacitively coupled to the ground plane by a capacitor component.

4. An antenna structure as defined in claim 3, wherein the main radiator and ground plane are disposed on different layers of a printed circuit board, and the ground plane and closed end overlap.

5. An antenna structure as defined in claim 1, wherein the ground plane, main radiator, and parasitic conductor ring are coplanar.

6. An antenna structure as defined in claim 5, wherein the ground plane, main radiator, and parasitic conductor ring are disposed on a printed circuit board.

7. An antenna structure as defined in claim 6, wherein the main radiator has a shape such that at least a portion of the main radiator conforms to an edge of the printed circuit board.

8. An antenna structure as defined in claim 1, wherein the parasitic conductive ring is ground to the ground plane at a point on the loop closest to the ground plane.

9. A mobile communication device, comprising:

a multi-mode transceiver;

a circuit board; and an antenna structure disposed on the circuit board, comprising:

a ground plane;

a main radiator including a closed end extending away from the ground plane to main portion of the main radiator, the main portion extending to an open end, the main radiator further having a feed point located on the main portion between the closed end and the open end, the multi-mode transceiver coupled to the antenna structure at the feed point, the closed end being capacitively coupled to the ground plane; and a parasitic conductor ring disposed in proximity to and parasitically coupled with the open end, and grounded to the ground plane.

10. A mobile communication device as defined in claim 9, wherein the open end extends from the main body section along a portion of the parasitic conductor ring.

11. A mobile communication device as defined in claim 9, wherein the closed end is capacitively coupled to the ground plane by capacitor component.

12. A mobile communication device as defined in claim 9, wherein the ground plane, main radiator, and parasitic conductor ring are coplanar and disposed on a common layer of the printed circuit board.

13. A mobile communication device as defined in claim 9, wherein the main radiator has a shape such that at least a portion of the main radiator conforms to an edge of the printed circuit board.

14. A mobile communication device as defined in claim 9, wherein the parasitic conductive ring is ground to the ground plane at the ring on the loop closest to the ground plane.

15. A mobile communication device as defined in claim 9, wherein the main radiator and ground plane are disposed on different layers of a printed circuit board, and the ground plane and closed end overlap.

* * * * *